US006705779B2

(12) United States Patent
Castellarin et al.

(10) Patent No.: US 6,705,779 B2
(45) Date of Patent: Mar. 16, 2004

(54) AUTOMATIC REPLENISHMENT FOR A TREATMENT COMPARTMENT OF A PHOTOFINISHING APPARATUS

(75) Inventors: Silvano Castellarin, Casarsa della Delizia (IT); Eni Scodellaro, Cordenons (IT)

(73) Assignee: San Marco Imaging Srl, Veneto (IT)

( * ) Notice: Subject to any disclaimer, the term of this patent is extended or adjusted under 35 U.S.C. 154(b) by 104 days.

(21) Appl. No.: 09/818,348

(22) Filed: Mar. 27, 2001

(65) Prior Publication Data

US 2001/0026690 A1 Oct. 4, 2001

(30) Foreign Application Priority Data

Mar. 28, 2000 (EP) ..... 00106025

(51) Int. Cl.[7] ..... G03D 3/02
(52) U.S. Cl. ..... 396/578; 396/626; 396/636
(58) Field of Search ..... 396/564–641; 430/30, 399, 400; 355/27–29, 77; 134/64 P, 64 R, 122 P, 122 R

(56) References Cited

U.S. PATENT DOCUMENTS

| | | | | | |
|---|---|---|---|---|---|
| 3,990,088 | A | * | 11/1976 | Takita | 396/626 |
| 4,215,719 | A | * | 8/1980 | Laar et al. | 137/563 |
| 4,705,379 | A | * | 11/1987 | Kobayashi et al. | 137/563 |
| 5,416,552 | A | * | 5/1995 | Fakler | 396/626 |
| 5,452,046 | A | * | 9/1995 | Ishida et al. | 396/626 |
| 5,459,545 | A | * | 10/1995 | Tsubaki et al. | 396/626 |
| 5,981,152 | A | * | 11/1999 | Komatsu | 430/434 |

* cited by examiner

*Primary Examiner*—D. Rutledge
(74) *Attorney, Agent, or Firm*—Peter F. Corless; Steven M. Jensen; Edwards & Angell, LLP

(57) ABSTRACT

The invention relates to an arrangement for preparing a liquid treatment solution for treating photosensitive material, said arrangement including a storage container for storing fresh treating solution to be fed to a development compartment of a development apparatus, a supply portion for supplying a dry component or components and/or one or several mixtures of components for preparing the treatment solution and a reception container for receiving a solvent, wherein according to the invention a mixing tank is interposed between said supply portion, said reception container and said storage container.

11 Claims, 1 Drawing Sheet

AUTOMATIC REPLENISHMENT FOR A TREATMENT COMPARTMENT OF A PHOTOFINISHING APPARATUS

FIELD OF THE INVENTION

The present application relates to an arrangement for preparing a liquid treatment solution for treating, e.g. developing photosensitive material.

BACKGROUND OF THE INVENTION

In the field of photofinishing technologies, two types of photofinishing environments are mainly known. One of these types concerns minilabs and the other, large scale photofinishing laboratories. In the minilabs, all kinds of processing needed for the exposed film, for the exposure of the photosensitive paper and the development of the exposed photosensitive paper as well as all splicing and cutting operations necessary for the exposed and developed film and the exposed and developed photosensitive paper are dealt with in one small scale minilab. This minilab is able to process small to medium numbers of films and/or photographs.

On the other hand, large scale photofinishing laboratories are able to process a huge number of exposed films which are arranged in film batches. These film batches are processed in special high speed printer devices.

In minilabs it is useful to conduct most of the operations, if not all operations, automatically without wasting time.

Minilabs include several compartments directed to the treatment of the exposed film and several compartments directed to the treatment of the exposed photopaper. In the known minilabs as well as in the known types of large scale photofinishing laboratories, the replenishment of these compartments is not sufficiently operated automatically and some times have to be replenished, if the treating solution in the compartments is no longer useful for an acceptable result.

SUMMARY OF THE INVENTION

Accordingly, it is an object of the present invention to improve the known arrangements by providing an arrangement for preparing a liquid treatment solution for the treatment of photosensitive material. In particular, it is an object of the present invention to propose such a new arrangement which is able to provide a fresh treatment solution without any time delay.

The solution to deal at least partially with these objects is an arrangement for preparing a liquid treatment solution for treating photosensitive material, such as photosensitive film material or photosensitive paper material, comprising: a storage container for storing said treatment solution to be fed to a development compartment of a development apparatus; a supply portion for a dry component or dry components and/or dry mixtures of components of said treatment solution; a reception container for receiving and storing a solvent, e.g. water, distilled water or the like; wherein a mixing tank is located between said supply portion, said reception container and said storage container, said parts being connected to said mixing tank.

Particularly useful and advantageous embodiments of the invention are set forth in the sub-claims.

The present invention can be used for all processes in connection with the development of photographic material, i.e. all developing, desilvering, washing and stabilizing processes, to dissolve and supply the granules of the necessary chemical components for each of the steps.

Of course, the photographic material can be a photographic film or a photographic print paper, both for color and black-and-white shots and prints.

Accordingly, the combination of different tanks and containers can be arranged for preparing not only a developer, but also a bleacher or a bleach-fixer for a desilvering step, a stabilizer for a non-water washing step and a stabilizer for a dye-stabilizing step, respectively.

Accordingly, e.g. a silver halide color photographic light-sensitive material after being exposed to light, is then processed in the steps such as a series of developing, desilvering, washing and stabilizing steps. And, a silver halide black-and-white photographic light-sensitive material, after exposed to light, is then processed in the series of developing and fixing steps. In these processes, a black-and-white developer or a color developer for carrying out a developing step, a bleacher or a bleach-fixer for a desilvering step, city water or deionized water for a washing step, a stabilizer for a non-water washing step, and a stabilizer for a dye-stabilizing step, respectively.

In general, a processing device according to the invention includes for instance a developing unit, a fixing unit, a desilvering unit, a washing or stabilizing unit and a drying unit and also a means for automatically transporting a photographic light-sensitive material through each of the processing tanks or compartments.

However, for simplification in the following it is only referred to the developing of films and prints, while the invention is also related to the e.g. fixing, bleaching or whatever process.

The advantages of the present invention are based on the fact that an additional mixing tank is located between a supply portion, a reception container and a storage container, wherein said parts are connected to the mixing tank by conduits. With this new feature of the invention, it is possible to prepare a new developer solution on the basis of dry components in connection with the solvent, which will usually be water or distilled water, while, at the same time, when mixing the new liquid developer solution, unused and active liquid developer solution is available for the development compartment of a development apparatus in a minilab or in a large scale photofinishing laboratory. Correspondingly, if the fresh liquid development solution has been pumped or withdrawn from the storage container to the development compartment of the development apparatus, the prepared fresh developer solution from the mixing tank can be supplied to the storage container and, immediately afterwards, the components of the development solution can be introduced into the mixing tank to prepare a new charge of the liquid developer solution. This is in particular important if dry ingredients in the form of powder or granules have to be disoluted in the solvent, e.g. water, which takes considerable time which can delay the overall function of the respective development apparatus and, correspondingly, of the complete minilab or the complete large scale photofinishing laboratory.

It is an advantageous embodiment of the present invention that the supply portion includes at least one and in particular two or more connecting locations for connecting replaceable vessels to the arrangement according to the arrangement. The vessels are, for instance, replaceable cartridges or the like which can be placed at the connecting locations to introduce the dry component or components or mixtures of the dry components to compose the liquid developer solution. For instance, the connecting locations can include flange devices or the like in connection with a pivotable lid or similar, which can be opened after the flange device has been fixably connected to the connecting location of the supply portion. The replaceable vessels or cartridges can be protected by housings to avoid possible damaging of the cartridges which could soil or spoil the liquid developer solution.

According to an advantageous embodiment including features in accordance with the invention, the storage container includes a sensor means which is able to monitor at least one particular level of the developer solution. This particular level of the developer solution in the storage container can also be merely a signal indicating that the storage container is empty. Of course, the sensor means in the storage container can also provide a continuous measurement showing all possible levels, i.e. the full level, all intermediate levels and also the empty state of the storage container.

According to another important embodiment in accordance with the present invention the mixing tank also includes a sensor means which is to monitor at least one particular level of a solvent and/or a liquid in said tank. Also this sensor means can provide a signal when the mixing tank is empty, i.e., if the fresh developer solution has been forwarded to the storage container. On the other hand, the sensor means of the mixing tank can also provide a signal when the mixing tank has been filled with a particular amount of material to be mixed to obtain the homogeneous fresh developer solution. Of course, this sensor of the mixing tank can also issue signals for all intermediate levels between the two levels, i.e. the maximum level and the minimum level. The maximum level should be adjustable so that it is possible to change the maximum amount of developer solution to be prepared in the mixing tank.

Accordingly, also the reception container should include a sensor means capable of detecting the level of the solvent, e.g. water, distilled water, or the like, in the reception container. It is also possible to only monitor the empty state of the reception container.

The storage container is connected via a conduct to said development compartment of the development apparatus, minilab or similar. Through this condridge said developer solution can be transported. This can be realised by sucking the developer solution or by creating a pressure in the storage container. If the storage container is placed above the development compartment, it is also possible to transport the developer solution by gravity only. However, a pumping means can be operated to transport the developer solution from the storage container to the development compartment.

To initiate the transport of the developer solution from the arrangement according to the invention to the development compartment, the development compartment should include a sensor indicating, when to change said developer solution. This sensor in the developer compartment should monitor the activity of the developer solution in the development compartment. If necessary, several sensor means for monitoring the activity of the developer solution in the developer compartment can be used to provide the necessary signals to activate the change of the old developer solution in the developer compartment to the fresh developer solution from the arrangement according the invention.

In a very secure but simple embodiment, it is possible that the sensor located in the storage container issues a signal when this container is empty. This signal can activate a valve to open a passageway from the mixing tank to the storage container to replenish the storage container. The sensor means installed in the mixing tank can also release a signal when the mixing tank is empty so that a valve is opened to replenish the mixing tank, if necessary, via a pump or the like, containing the solvent which has been supplied from the reception container. At the same, time the signal emitted by the sensor means of the mixing tank can also activate, i.e. open, the supply portion and the respective connecting locations of the supply portion. Afterwards, when the mixing tank has been filled to a certain level with the solvent and the dry components or mixtures from the supply portion and the replaceable vessels or cartridges respectively, the supply portion can be closed and the valve and/or pump can be controlled to stop feeding the solvent. At the same time or somewhat later a mixing device can be activated to support the dissolution process which takes place in the mixing tank. The mixing device can be, for instance, a stirring device or a loop-like convict with the pumping means or the like which generates a continuous movement in the solvent in the mixing tank to enhance the effectiveness of the dissolution process, i.e. to speed up the dissolution process.

BRIEF DESCRIPTION OF THE DRAWINGS

In the following, the invention will be described in more detail with reference to a particular embodiment in accordance with the invention. In the specification, further advantageous aims and features in accordance with the invention are disclosed.

The attached FIGURE shows an arrangement in accordance with the present invention in a principle cross-sectional view.

DETAILED DESCRIPTION OF THE PREFERED EMBODIMENTS

Figure 1:
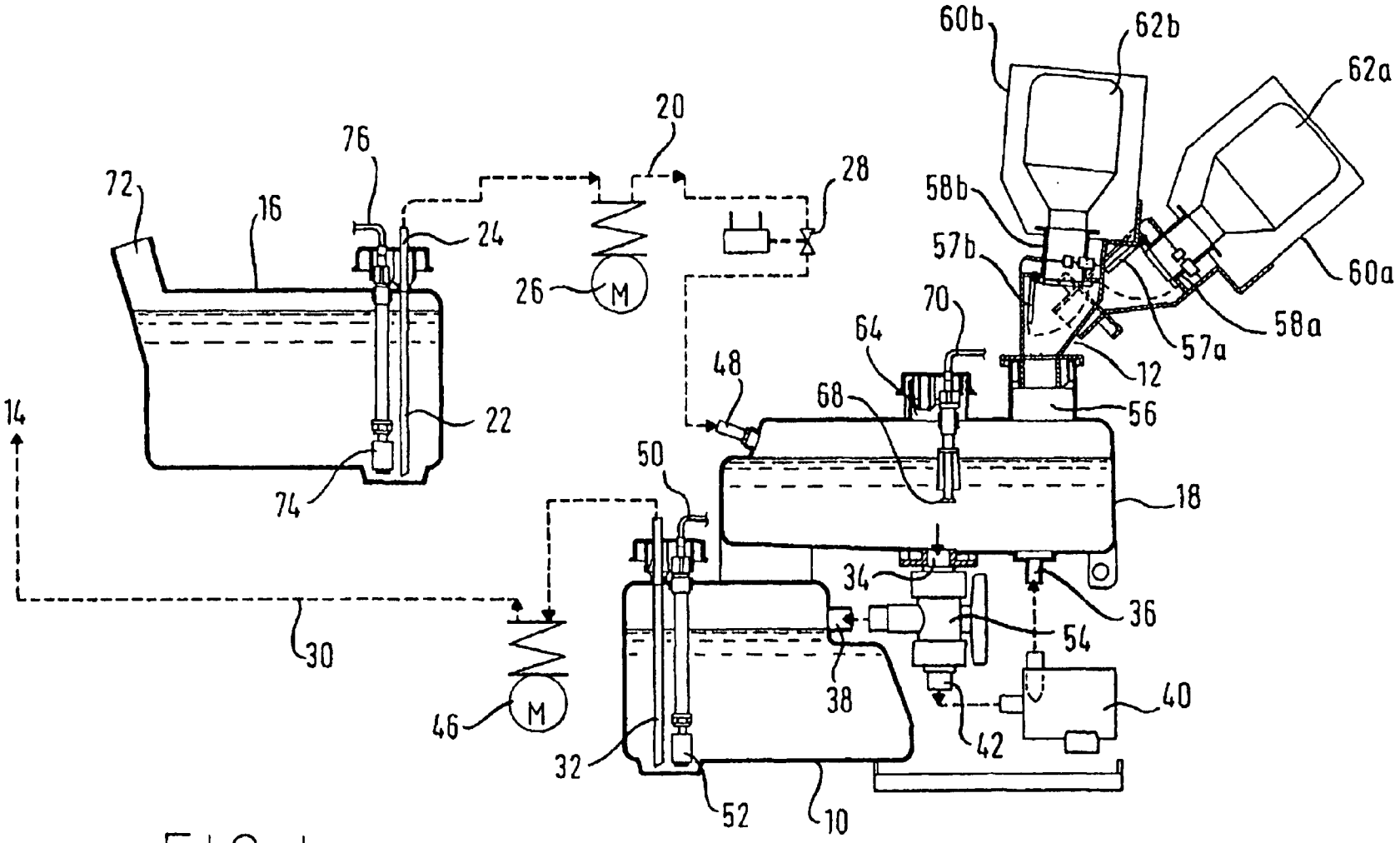

In the FIGURE, a storage container 10 is connected via a sucking pipe 32 and a pumping means 46 to a pipe connection 30 which ends in a developer compartment represented by the reference number 14.

When the pump, which for instance can be a transfer bellow pump, has emptied the storage container 10, a sensor 52 is able to detect this state of the storage container 10. The sensor holder of the sensor 52 can also include a vent pipe 50 to allow a pressure balance in the container 10 when developer is withdrawn or supplied to the tank 10.

The tank 10 has an inlet opening 38 which is connected to an outlet opening 34 of a mixing tank 18. The outlet opening 34 is connected to the inlet opening 38 via a three-way-valve 54 which can be switched in two different positions. In one position the three-way-valve 54 provides a connection between the mixing tank 18 and the storage container 10. In the other setting, the valve 54 connects the outlet opening 34 of a tank 18 to a connecting piece 42 of the valve 54. Said valve is fitted via a pipe to a pump 40 which has the purpose of moving the liquid in the tank 18 by sucking the liquid to the outlet opening 34 and re-feeding the liquid through another inlet 36 of the mixing tank 18 back into the mixing tank. Accordingly, the pump 40 generates a movement or flow in the tank to support any chemical reactions, such as for instance a dissolution of components introduced into the tank 18, and to help to provide a homogeneous developer solution which is composed of the solvent stemming from a reception compartment 16 and the dry components stemming from cartridges 62*a*, 62*b*.

The mixing tank 18 has two inlet openings. The inlet opening 56 connects a supply portion 12 to the mixing tank 18. The inlet opening 48 introduced the solvent from the reception container 16 through a pipe 20 into the mixing tank 18.

The solvent in the reception container 16, which can be replenished via an opening 72 into the container 16 is withdrawn via a sucking pipe 22. The sucking pipe 22, which is connected to the connection pipe 20, is connected to the container 16 via an opening 24. The opening 24 also supports a sensor 74 fixed to a holder through which a vent pipe 76 is also connected to the inner space of the container 16. The vent pipe 76 allows for pressure balance in the container 16 when the level of the solvent in the container 16 changes. The solvent can be transferred by a pump means 26 and the connecting pipe 20. To exactly control the amount of solvent to be supplied to the mixing tank 18, a valve, and in particular a solenoid valve 28, can be installed in the course of the connecting pipe 20 behind the pump 26.

In addition, the mixing tank 18 includes a level sensor 68 which is able to detect the levels of the amount of liquid existent in the tank 18. Moreover, the fixture of the level sensor 68 is provided with a vent pipe 70 to allow for a pressure balance in the tank 18. The level sensor 68 and the vent pipe 70 are introduced or connected, respectively, to the inner space of the tank 18 via an opening 64.

The supply portion 12 has several connecting locations 58*a*, 58*b* to which replaceable cartridges 62*a*, 62*b* can be connected. The replaceable cartridges 62*a*, 62*b* themselves or the connecting locations 58*a*, 58*b* can incorporate some lids 57*a*, 57*b*, which can be opened after a cartridge has been connected to the respective connecting location and closed before an emptied replaceable cartridge is removed. The purpose of this is to avoid dust or dirt being accidently introduced into the mixing tank and spoiling the fresh developer solution which has been prepared.

As can be seen, the replaceable cartridges 62*a*, 62*b* are protected by housings 60*a*, 60*b* so that the cartridges cannot be accidently damaged.

All the sensors 52, 68, 74 of this arrangement can activate the necessary actuators to accomplish a proper function of the arrangement according to the invention. Thus, the sensor 52 can actuate the three-way-valve 42 or alternatively a two-way-valve to replenish the container 10 with fresh developer from the mixing tank 18. In case of the appliance of a two-way-valve, the mixing loop including the pump 40 is always open and only an additional connecting conduit between the mixing tank 18 and the storage container 10 is controlled by such a two-way-valve. The pump 46 can be activated by one or several sensors in the development compartment, if the used developer in the development compartment has been poured out and fresh developer from the container 10 has be replenished into the development compartment 14. The sensor 68 can detect when the mixing tank 18 is empty and can, after the valve 54 has been closed, activate the solenoid valve 28 and, if necessary, the pump 26, to introduce solvent, e.g. water, from the container 16 into the tank 18. At the same time, the signal from the sensor 68 can activate the supply portion 12 to introduce the necessary amount of dry ingredients for the developer solvent into the tank 18.

When the level sensor 68 detects that the maximum level has been reached, or, if possible beforehand, the valve 54 can be controlled to be set to connect a mixing pump 40 to the mixing tank 18.

Of course, the different functions said forth above can also be accomplished by a central control processor or a central control computer which is part of the development apparatus or the minilab which incorporates the development compartment 14.

To be able to provide a turbulent stream or flow in the mixing tank 18 to dissolute the granules more quickly, the inlet 36 can be connected to one or more distribution conduits. This or these distribution conduits can be extended to different locations in the mixing tank 18. It is also possible to use one distribution pipe, extending from one end of the mixing tank 18 to the other, said pipe being provided with many orifices to deliver the content of the mixing tank 18 during the mixing and dissolution procedure.

It is also possible to install a distribution arrangement for the granules so that the granules are initially widely spread in the tank 18 before the mixing or dissolution procedure begins.

It has to be kept in mind, that all treatment liquids which may be appropriate for a photo-finishing process can be prepared in accordance with these embodiments. Furthermore, of course, several of the above arrangements in practice can be operated in parallel to dissolve the ingredients and to provide the treatment liquids.

What is claimed is:

1. An arrangement for preparing a liquid treatment solution for treating photosensitive material, such as photosensitive film material or photosensitive paper material, comprising:

a) a storage container for storing said treatment solution to be fed to a treating compartment of a treating apparatus;

b) a supply portion for a dry component or dry components and/or dry mixtures of components of said treatment solution;

c) a reception container for receiving and storing a solvent; and d) a mixing tank located between said supply portion, said reception container and said storage container, wherein said supply portion, said reception container and said storage container are connected to said mixing tank, and said storage container has an inlet opening which is connected to an outlet opening of said mixing tank for transmitting said treatment solution to the storage container.

2. An arrangement according to claim 1, wherein said supply portion includes at least one and particularly two or more connection locations for connecting replaceable vessels or cartridges to introduce said dry component(s) or mixture(s) of components from said replaceable vessels or cartridges into said supply portion.

3. An arrangement according to claim 1, wherein said storage container comprises a sensor means for monitoring at least one particular level of said treatment solution and/or when said storage container is empty.

4. An arrangement according to claim 1, wherein the mixing tank includes a sensor means for monitoring at least one particular level of a solvent and/or a liquid in the tank.

5. An arrangement according to claim 1, wherein the reception container includes a sensor means for monitoring at least one particular level of solvent and/or a liquid in the reception container.

6. An arrangement according to claim 1, wherein the storage container is connected to a development compartment via a conduit through which said treatment solution can be transported.

7. An arrangement according to claim 6, wherein said development compartment includes at least one sensor indicating when to change said treatment solution, said at least one sensor emitting a replenishment signal initiating the transfer of said treatment solution from said storage container to said development compartment.

8. An arrangement according to claim 1, wherein said mixing tank is emptied into said storage container after the storage container has been emptied into said treating compartment.

9. An arrangement according to claim 8, wherein said mixing tank is fed by said reception container and/or by said supply portion after said mixing tank has been emptied into said storage container.

10. An arrangement according to claim 1, wherein said mixing tank is provided with a mixing device.

11. An arrangement according to claim 1, comprising a control means controlling at least partial replenishment and/or mixing operations in said arrangement.

* * * * *